US006134743A

United States Patent [19]

Schmidt

[11] Patent Number: 6,134,743

[45] Date of Patent: Oct. 24, 2000

[54] SCRAPING TOOL SYSTEM

[75] Inventor: G. Gerry Schmidt, Newport Beach, Calif.

[73] Assignee: Pacific Handy Cutter, Inc., Costa Mesa, Calif.

[21] Appl. No.: 09/136,347

[22] Filed: Aug. 19, 1998

[51] Int. Cl.[7] ..... A47L 13/022

[52] U.S. Cl. ..... 15/236.01; 15/111; 15/145; 15/236.05; 15/236.08; 7/105; 7/158; 7/165; 16/422; 224/673; 224/684; 224/904

[58] Field of Search ..... 16/422, 114 R; 15/236.01, 236.02, 236.03, 236.04, 236.05, 236.06, 236.07, 236.08, 236.09, 145, 111; 30/169, 170, 339; 81/177.1, 489; 7/105, 114, 158, 165; 224/904, 673, 674, 683, 684

[56] References Cited

U.S. PATENT DOCUMENTS

| | | | |
|---|---|---|---|
| 180,187 | 7/1876 | Bartlett | 30/169 |
| D. 263,922 | 4/1982 | Bruno . | |
| 272,649 | 2/1883 | Cline . | |
| D. 282,716 | 2/1986 | Heinis et al. . | |
| D. 306,925 | 3/1990 | Bell . | |
| D. 332,160 | 12/1992 | Kuzma . | |
| D. 341,453 | 11/1993 | Roma et al. . | |
| D. 364,719 | 11/1995 | Crawford . | |
| D. 377,856 | 2/1997 | Hartman . | |
| D. 380,661 | 7/1997 | Lehmann . | |
| D. 388,572 | 12/1997 | Gold . | |
| D. 394,534 | 5/1998 | Coulter . | |
| 401,442 | 4/1889 | Lefebure . | |
| 604,379 | 5/1898 | Flyckt | 16/422 |
| 718,534 | 1/1903 | Shedd . | |
| 925,259 | 6/1909 | Ziegler . | |
| 946,723 | 1/1910 | Coffin . | |
| 1,063,436 | 6/1913 | Hanson . | |
| 1,082,802 | 12/1913 | Full . | |
| 1,434,744 | 11/1922 | Hibbler . | |
| 1,829,499 | 10/1931 | Boos . | |
| 2,291,015 | 7/1942 | Anderson . | |
| 2,664,945 | 1/1954 | Maresca . | |
| 2,674,794 | 4/1954 | Baker . | |
| 3,173,206 | 3/1965 | Chambers . | |
| 3,176,395 | 4/1965 | Warner et al. . | |
| 3,187,431 | 6/1965 | Mattes | 30/339 |
| 3,436,823 | 4/1969 | Lamb et al. . | |
| 3,673,383 | 6/1972 | Sofia . | |
| 4,241,496 | 12/1980 | Gregson | 30/339 |
| 4,481,689 | 11/1984 | Westmoreland . | |
| 4,614,380 | 9/1986 | Allen . | |
| 4,768,254 | 9/1988 | Bell . | |
| 5,027,512 | 7/1991 | Andrews . | |
| 5,058,273 | 10/1991 | Streger . | |
| 5,211,322 | 5/1993 | Nealy . | |
| 5,467,498 | 11/1995 | Keegan et al. . | |
| 5,491,896 | 2/1996 | Stolzer et al. . | |
| 5,595,424 | 1/1997 | Nakagawa . | |
| 5,636,845 | 6/1997 | Newman . | |
| 5,813,083 | 9/1998 | Gould | 15/236.01 |

FOREIGN PATENT DOCUMENTS

| | | |
|---|---|---|
| 1186399 | 4/1970 | United Kingdom . |

*Primary Examiner*—Robert J. Warden, Sr.
*Assistant Examiner*—Kaj K. Olsen
*Attorney, Agent, or Firm*—Henricks, Slavin & Holmes LLP

[57] ABSTRACT

A scraping tool system includes a scraping tool, tools, and a holster with pockets for receiving and holding the scraping tool and the tools. The scraping tool has a handle member, a rod, a spring mechanism, and a lever mechanism. The rod is sized to be fitted within a channel of the handle member and includes a tool attaching portion. The rod is attached to the spring mechanism which, in turn, is fitted between the rod and a base portion of the handle member which includes a tapping heel plate. The lever mechanism is mechanically coupled to the handle member and to the spring mechanism and is adapted to reposition the rod along the channel in response to a movement of a portion of the lever mechanism relative to the handle member. The tools each include a mounting portion formed such that the tool is mechanically coupled to an end portion of the handle member when the lever mechanism is in a tool securing position.

24 Claims, 5 Drawing Sheets

FIG. 5
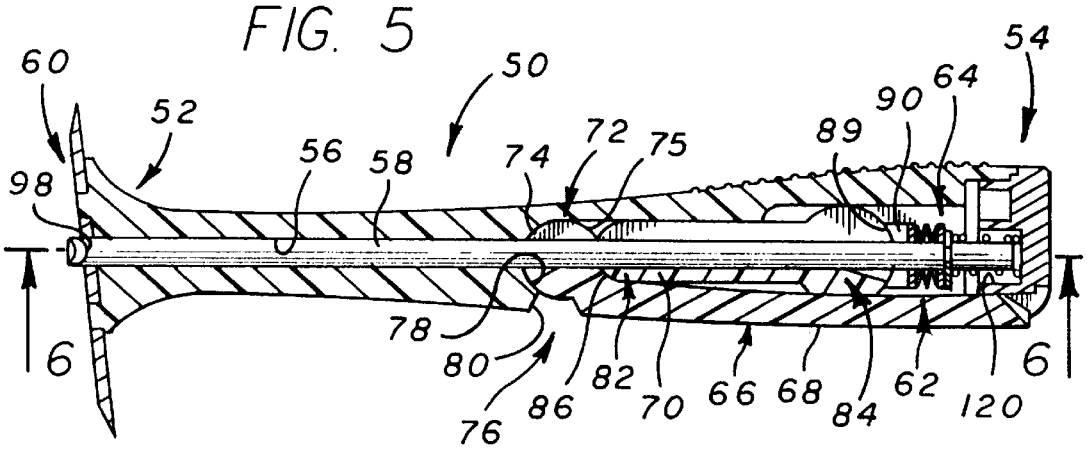
FIG. 6
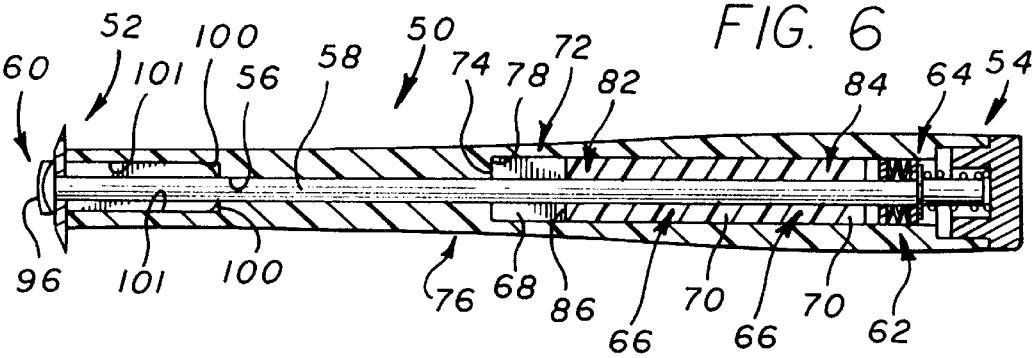
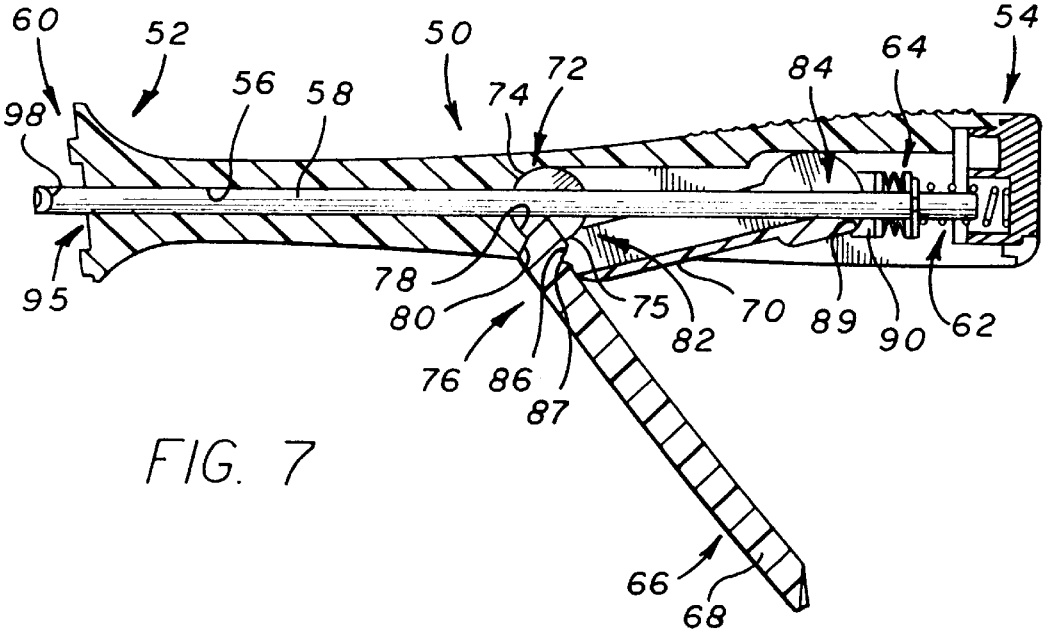
FIG. 7

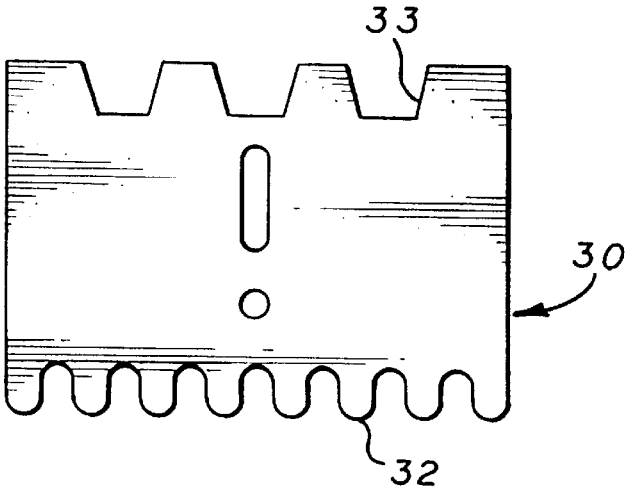
FIG. 8
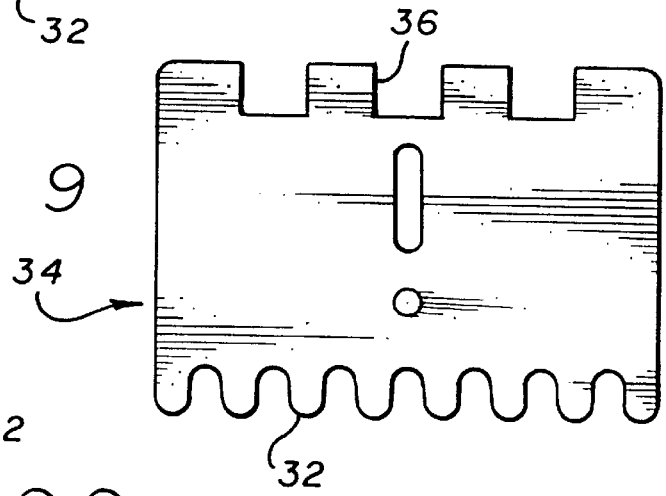
FIG. 9
FIG. 10
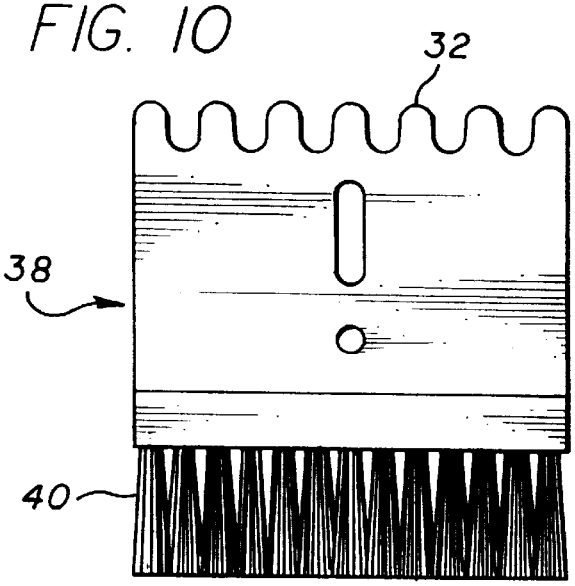
FIG. 11
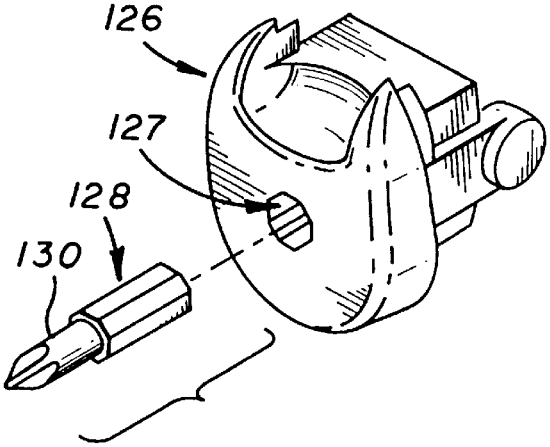

204
202
200

204
200
202

200
204
202

12C
12D
204
202
200
12C
12D 202
200
204

SCRAPING TOOL SYSTEM

BACKGROUND OF THE INVENTION

1. Field of the Invention

The present invention relates to a scraping tool system and, more particularly, pertains to a scraping tool with a handle member and an integrally-formed lever mechanism and tool attaching member for detachably securing tools such as blades to the handle member.

2. Description of the Related Art

The chore of scraping paint is never pleasant and usually very time consuming. Conventional paint scraping tools often include a handle and a blade that is secured to the handle, typically with a screw, see, e.g., U.S. Pat. No. 4,768,254 to Bell. With conventional scraping tools, the process of replacing dull blades is tedious and time consuming and typically requires the employment of additional tools such as a screw driver. A scraping tool facilitating quick and easy blade replacement without the need for additional tools would clearly improve the state of the art.

The blade replacement operation also requires that the worker have a replacement blade readily at hand. Thus, there is also a need for a scraping tool system wherein a scraping tool and a plurality of tools such as blades are all placed within close proximity to each other and easily accessible by the worker. Such a system would offer even more utility if a variety of different tools could all be used with a single handle member.

OBJECTS AND SUMMARY OF THE INVENTION

Thus, it is an object of the present invention to provide a scraping tool system addressing the needs discussed in the preceding section.

In accordance with a specific illustrative embodiment of the present invention, A scraping tool system including a scraping tool, plurality of tools and a body-worn holster. The scraping tool includes: a handle member including an end portion and a base portion, the handle member being formed with a channel within the handle member, the base portion including a tapping heel plate; a rod sized to be fitted within the channel, the rod including a tool attaching portion and a rod securing portion; a spring mechanism to which the rod securing portion is attached, the spring mechanism being fitted between the rod and the base portion of the handle member; and a lever mechanism mechanically coupled to the handle member and the spring mechanism and adapted to reposition the rod within the channel in response to a movement of the lever mechanism relative to the handle member. The plurality of tools each include a mounting portion formed such that the tool is mechanically coupled to the tool attaching portion and secured to the end portion applying a spring force against the tool attaching portion when the lever mechanism is moved to a tool securing position. The body-worn holster has pockets adapted to receive the scraping tool and the plurality of tools.

In another aspect of the present invention, a scraping tool system includes a scraping tool, a plurality of tools, and a holster with pockets adapted to receive the scraping tool and the plurality of tools. The scraping tool, in turn, includes a handle member, a rod, a spring assembly, and a lever assembly. The handle member includes an end portion and a base portion and is formed with a channel. The rod is sized to be fitted within the channel of the handle member and includes a tool attaching portion and a rod securing portion.

The spring assembly is attached to the rod securing portion and is fitted between the rod and the base portion of the handle member. The lever assembly is mechanically coupled to the handle member and the spring assembly and is adapted to reposition the rod within the channel in response to a movement of the lever assembly relative to the handle member. The plurality of tools each include a mounting portion formed such that the tool is mechanically coupled to the tool attaching portion and secured to the end portion of the handle member when the lever assembly is moved to a tool securing position.

In another aspect of the present invention, a scraping tool system includes: a handle member including an end portion and a base portion, the handle member being formed with a channel within the handle member; a rod sized to be fitted within the channel, the rod including a tool attaching portion and a rod attachment portion; a spring mechanism to which the rod attachment portion is attached, the spring mechanism being fitted between the rod and the base portion of the handle member; and a lever mechanism mechanically coupled to the handle member and the spring mechanism and adapted to reposition the rod within the channel in response to a movement of the lever mechanism relative to the handle member.

In another aspect of the present invention, a scraping tool system includes: a handle member including an end portion and a base portion, the handle member being formed with a channel within the handle member; a rod sized to be fitted within the channel, the rod including a tool attaching portion and a rod attaching portion; a spring assembly to which the rod attachment portion is attached, the spring assembly being fitted between the rod and the base portion of the handle member; and a biasing mechanism mechanically coupled to the handle member and the spring assembly and adapted to reposition the rod within the channel in response to a movement of a portion of the biasing mechanism relative to the handle member.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 5 is cross-sectional side view of the scraping tool of FIG. 2 showing the lever mechanism in its closed position;

FIG. 6 is cross-sectional top view of the scraping tool of FIG. 2 showing the lever mechanism in its closed position;

FIG. 7 is cross-sectional side view of the scraping tool of FIG. 2 showing the lever mechanism in its open position;

FIG. 8 shows an alternative tool in the form of a grill cleaning tool with two identical scraping edges;

FIG. 9 shows a second alternative tool in the form of a grill cleaning tool with two different scraping edges;

FIG. 10 shows a third alternative tool in the form of a grill cleaning tool with a scraping edge and a brushing edge;

FIG. 11 is a perspective view of an alternative embodiment of the heel plate of the handle member of FIG. 2 and a hexagonal tool bit wherein the alternative heel plate includes an indentation sized to receive the tool bit;

DETAILED DESCRIPTION OF THE PREFERRED EMBODIMENTS

Figure 1:
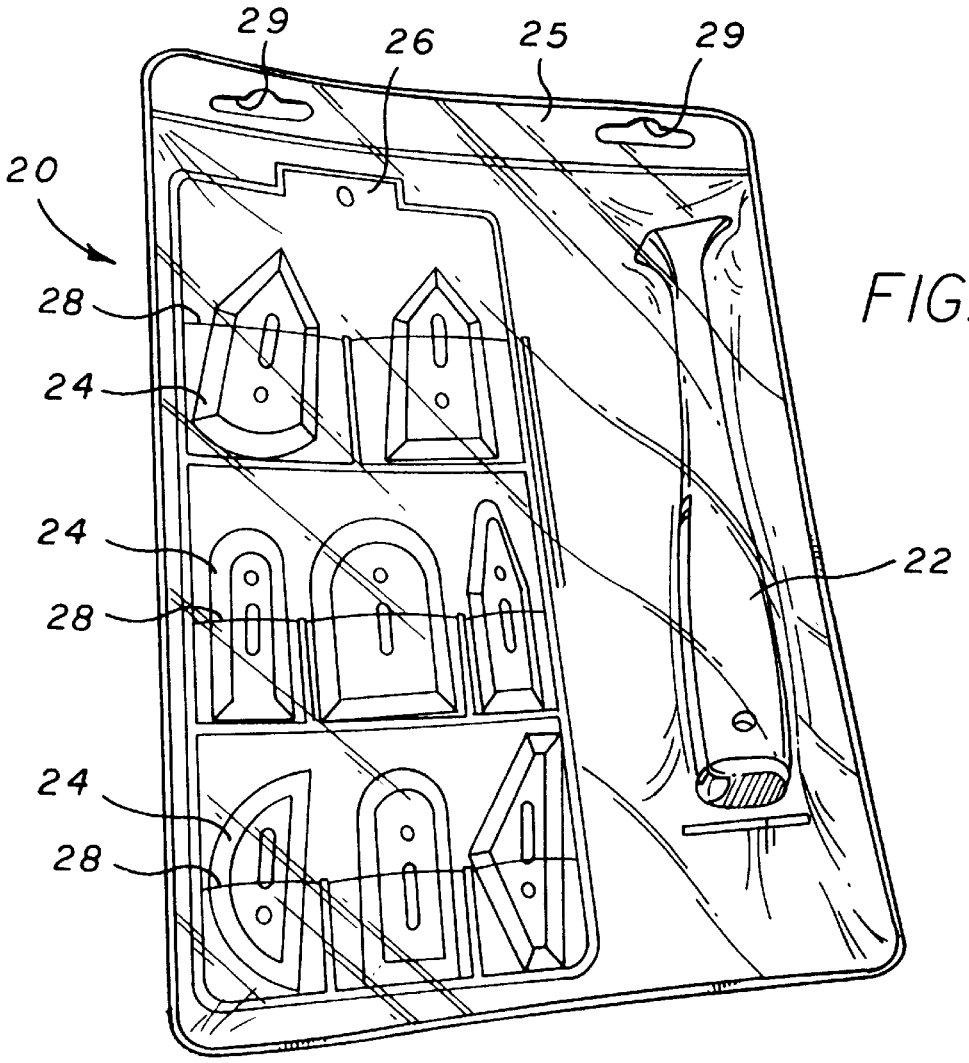
FIG. 1 shows an exemplary preferred embodiment of a scraping tool system according to the present invention, the system including a scraping tool, a plurality of tools, and a body-worn holster configured to hold the scraping tool and the tools.

Referring to FIG. 1, an exemplary preferred embodiment of a scraping tool system 20 includes a scraping tool 22, a plurality of tools 24 and a holster 25. The system 20 also includes a tool-holding mechanism 26 sized to be fitted into the holster 25 as shown. The tool-holding mechanism 26 includes pockets 28 sized to receive and hold the tools 24. The holster 25 and the tool-holding mechanism 26 are preferably made from a light-weight plastic material with the holster 25 being adapted to be worn on the body of a worker, e.g., attached at slots 29 to a belt worn by the worker. The pockets 28 are preferably sized such that a portion of each tool 24 extends from the pocket when fully inserted into the pocket 28 thereby making the tool 24 easier to grasp and remove from the pocket 28. The plastic material forming the pockets 28 is preferably, but not necessarily, transparent so that the tools 24 are easy to identify even when stored in the pockets 28.

The plurality of tools 24 shown in FIG. 1 comprise eight blades differing in shape. It should be understood, however, that the present invention also contemplates a plurality of tools 24 where some or all of the tools 24 are the same. Furthermore, tools other than blades can be included in the scraping tool system 20. By way of example, FIG. 8 shows an alternative tool in the form of a grill cleaning tool 30 with a scraping edge 32 with rounded ridges and a scraping edge 33 with trapezoidal ridges. FIG. 9 shows a second alternative tool in the form of a grill cleaning tool 34 with two different scraping edges, i.e., a scraping edge 32 (as in FIG. 8) and a scraping edge 36 with rectangular or square ridges spaced further apart than the ridges of the scraping edge 32. FIG. 10 shows a third alternative tool in the form of a grill cleaning tool 38 with a scraping edge 32 (as in FIG. 8) and a brushing edge 40. The tools 30, 34, 38 are preferably made of brass, but can be made of other metals, alloys or non-metallic materials. The brushing edge 40 preferably comprises a brass brush.

Figure 2:
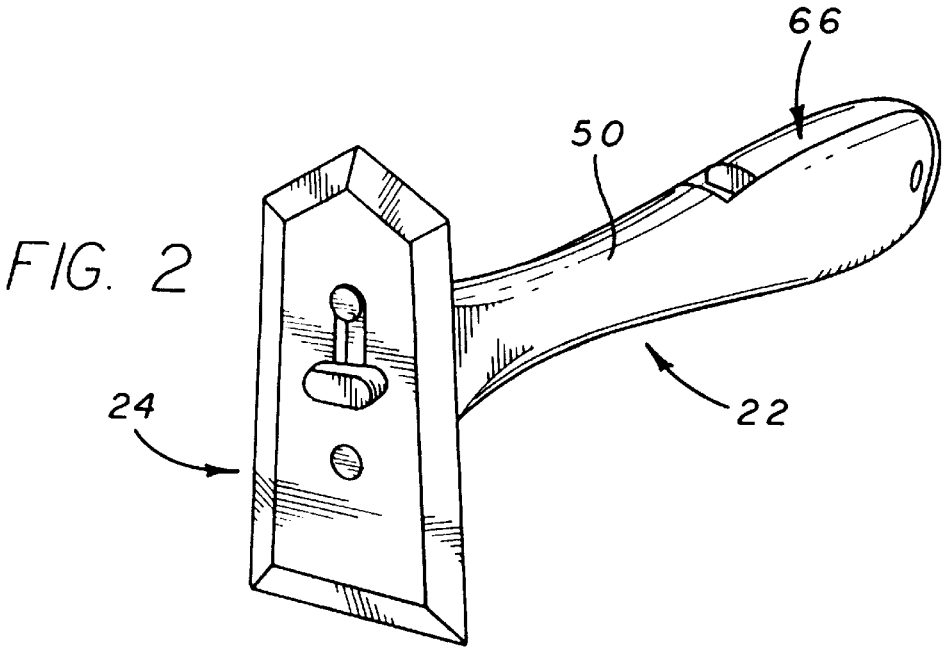
FIG. 2 is a perspective view of a handle member, a blade, a tool attaching portion of a rod within the handle member, and a lever mechanism of the scraping tool of FIG. 1 with the tool attaching portion securing the blade to an end portion of the handle member.

Referring to FIG. 2, the scraping tool 22 includes a handle member 50 shaped as shown. Referring to FIG. 5, the handle member 50 includes an end portion 52 and a base portion 54. The handle member 50 is formed with a channel 56 along its length. The scraping tool 22 also includes a rod 58 sized to be fitted within the channel 56, the rod 58 including a tool attaching portion 60 and a rod attachment portion 62 on opposing ends of the rod 58. The scraping tool 22 also includes a spring assembly or spring mechanism 64 to which the rod attachment portion 62 is attached. The spring assembly 64 is fitted on the rod 58 between the base portion 54 of the handle member 50 and the tool attaching portion 60. The scraping tool 22 also includes a biasing mechanism for repositioning the rod 58 within the channel 56. An exemplary preferred biasing mechanism comprises a lever assembly or lever mechanism 66 which is mechanically coupled to the handle member 50 and the spring assembly 64 and adapted to reposition the rod 58 within the channel 56 in response to a movement of a portion of the lever mechanism 66 relative to the handle member 50.

Figures 3, 4:
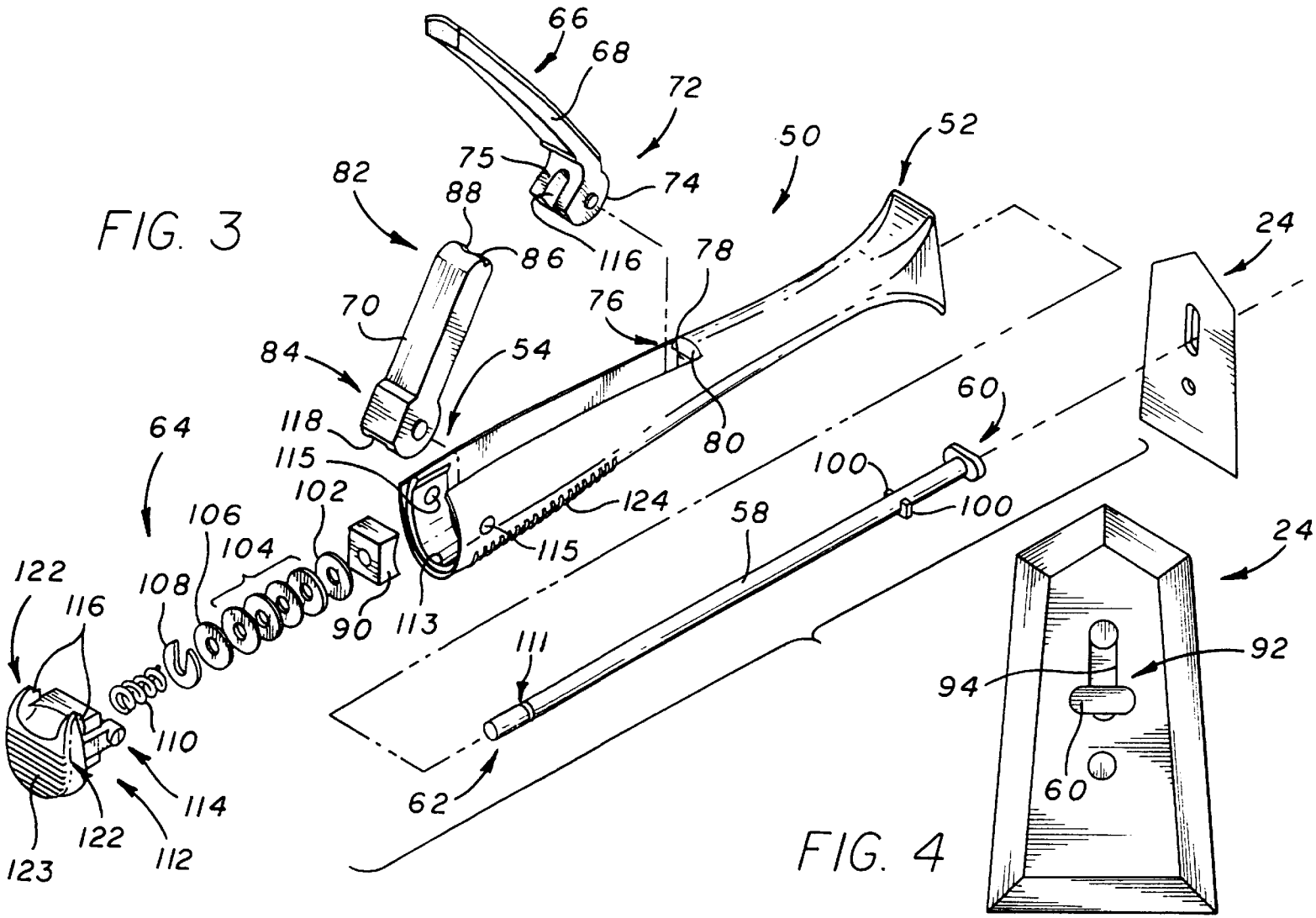
FIG. 3 is an exploded perspective view of the scraping tool of FIG. 2 additionally showing a spring mechanism of the scraping tool and showing the blade separated from the tool attaching portion of the rod.
FIG. 4 is an enlarged end view of the blade and tool attaching portion shown in FIG. 2.
Figures 12A, 12B, 12C, 12D, 12E:
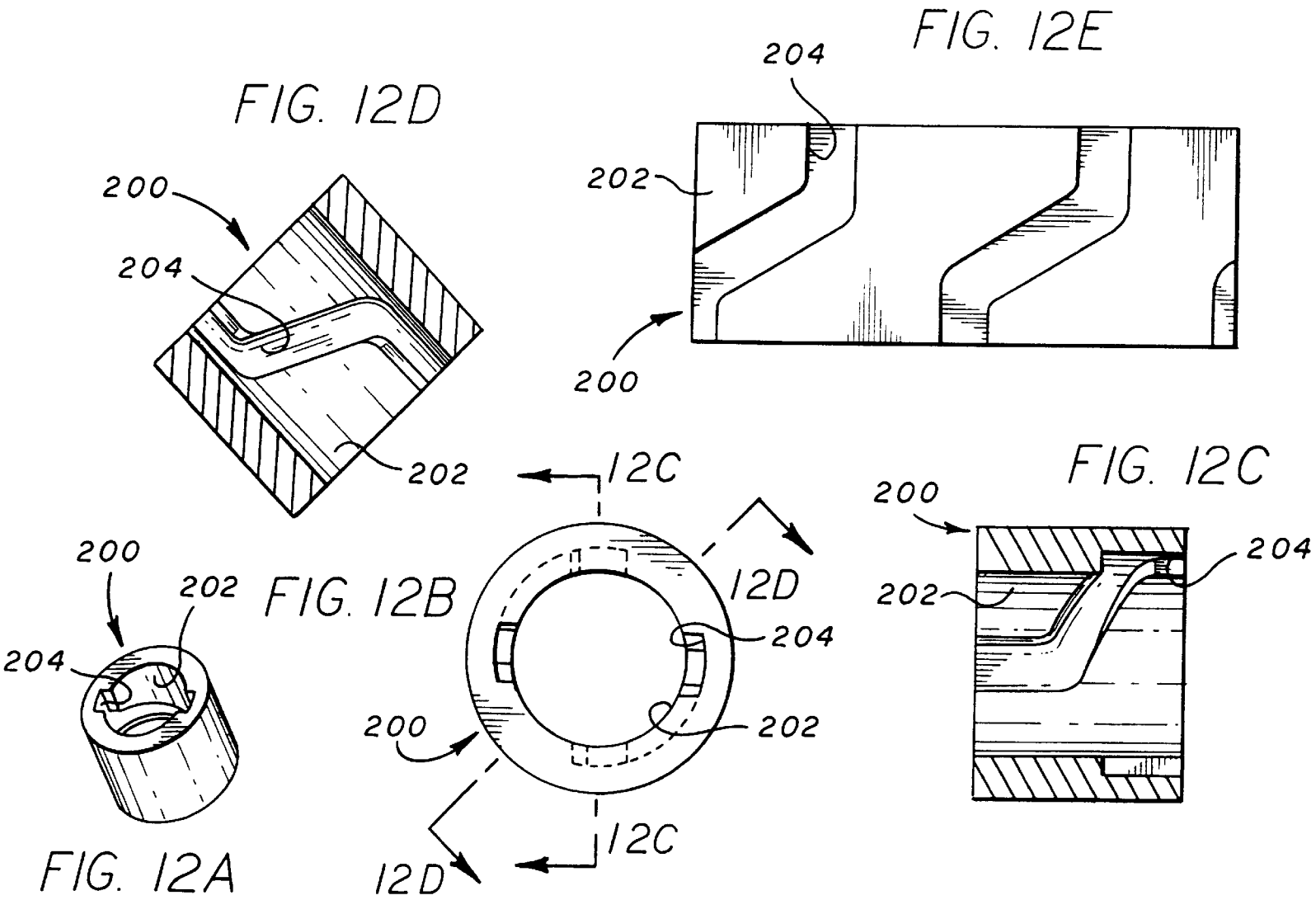
FIG. 12A shows a perspective view of a cam insert member for an end portion of the handle member.
FIG. 12B is a cross-sectional view of the cam insert member of FIG. 12A.
FIG. 12C is a cross-sectional view of the cam insert member along line A—A of FIG. 12B.
FIG. 12D is a cross-sectional view of the cam insert member along line B—B of FIG. 12B.
FIG. 12E is an unrolled view of the cam insert member of FIG. 12A.

Referring to FIG. 3, the lever assembly 66 includes a release lever 68 and a link lever 70. The release lever 68 includes a camming portion 72 with a curved surface 74 and a cammed surface 75. The release lever 68 is mechanically coupled to the handle member 50 by virtue of a recess 76 formed in the handle member 50. More specifically, the recess 76 includes a surface 78 complementary to the curved surface 74. As best shown in FIGS. 5 and 7, the recess 76 also includes a beveled surface 80 to limit the pivoting motion of the release lever 68 away from the base portion 54 of the handle member 50.

Referring again to FIG. 3, the link lever 70 includes a linking portion 82 and a thrusting portion 84. The linking portion 82 includes a surface 86 complementary to the cammed surface 75. As shown in FIG. 7, the cammed surface 75 is preferably formed with a ridge 87 sized to fit into a corresponding groove 88 (FIG. 3) on the surface 86. The ridge 87 snaps into the groove 88 when the release lever 86 is opened preventing the linking portion 82 of the link lever 70 from disengaging or separating from the camming portion 72 of the release lever 68.

The thrusting portion 84 of the link lever 70 is mechanically coupled to the spring assembly 64. More specifically, and as best shown in FIGS. 5 and 7, the thrusting portion 84 is shaped to complement a curved surface 89 of a thrust washer 90 which is positioned between the thrusting portion 84 of the link lever 70 and the spring assembly 64.

A key aspect of the present invention is that the lever assembly 66 allows a tool 24 to be quickly and easily secured to or released from the scraping tool 22. To this end, and referring to FIG. 4, each tool 24 includes a mounting portion 92 formed such that the tool 24 can be mechanically coupled to the tool attaching portion 60 of the rod 58. In the illustrated exemplary preferred embodiment, the mounting portion 92 includes a slot 94 shaped as shown and sized sufficiently larger than the tool attaching portion 60 to allow the tool attaching portion 60 to pass through the mounting portion 92.

Referring to FIG. 7, an indentation 95 on the end portion 52 of the handle member 50 functions as a spring into which the blade tool 24 flexes slightly when secured to the end portion 52 thereby minimizing blade chatter. This spring action also results in an assisting force being applied to the lever mechanism 66 when the worker begins to pivot the lever mechanism 66 away from the handle member 50 to release the blade 24.

FIG. 5 shows the scraping tool 22 with the lever mechanism 66 in a closed position which secures the tool 24 to the end portion 52 of the handle member 50. FIG. 7 shows the scraping tool 22 with the lever mechanism 66 in an open position which allows the tool 24 to be turned and separated from the tool attaching portion 60 of the rod 58. As best shown in FIG. 6, an additional feature of note is that the tool attaching portion 60 includes an outer curved surface 96 which makes it easier for the tool attaching portion 60 to be inserted through the slot 94. As best shown in FIGS. 5 and 7, the tool attaching portion 60 also includes an inner curved surface 98 which is in contact with the mounting portion 92 of the tool 24 when the lever mechanism 66 is in the closed position.

Referring again to FIG. 6, the rod 58 and the channel 56 are shaped such that the channel 56 contacts the rod 58 to prevent the rod from rotating about an axis parallel to the rod as the rod 58 is repositioned within the channel 56. More specifically, the rod 58 includes fins 100 which move along linear tracks 101 of the channel 56 thereby preventing the rod 58 from rotating within the channel 56. It should be understood that other means for preventing the rod 58 from rotating relative to the channel 56 are contemplated as being within the scope of the present invention.

An alternative preferred embodiment of the scraping tool 22 is configured such that the rod 58, and thus the tool attaching portion 60, rotates 90° when released. A 90° rotation of the tool attaching portion 60 from the closed position (where the tool attaching portion 60 is perpendicular to the slot 94) to the open position results in the tool attaching portion 60 being parallel to the slot 94. This feature provides the benefit of being able to more easily separate the blade 24 from the tool attaching portion 60. Also, by eliminating the need to rotate the blade 24 by hand to align the slot 94 and the tool attaching portion 60 during blade removal, the likelihood of a worker injuring himself or herself during the blade removal process is decreased.

The aforementioned rotation of the rod 58 during the blade releasing process can be accomplished in a number of different ways. Referring to FIGS. 12A–12E, the alternative preferred embodiment of the scraping tool 22 is provided with a die-cast cam insert member 200 which is fitted into a bored out end portion 52 of the handle member 50. The cam insert 200 has an inner surface 202 into which are cut two opposing tracks 204, one for each of the rod fins 100. Each track 204 is cut from one end of the insert member 200 to the other and travels approximately 90° around the inner surface 202 from one end of the track 204 to the other. The rod turning tracks 204 replace the linear tracks 101 of the previously described embodiment. However, it should be understood that the scope of the present invention additionally contemplates that the inside of the handle member 50 could simply be formed with the rod turning tracks 204 instead of the linear tracks 101, thus eliminating the need for a separate insert member 200. In either case, exemplary preferred turning tracks 204 are formed to provide 0.100 inches of travel for rotation, 0.124 inches of rod travel clearance and 0.153 inches of total rod travel.

Referring to FIG. 3, the spring assembly 64 includes a flat washer 102, disk springs 104, a flat washer 106, a retaining clip 108, and a spring 110 stacked as shown. The rod 58 includes a groove 111 about which the retaining clip 108 is fitted to secure the spring assembly 64 to the rod attachment portion 62 of the rod 58.

The base portion 54 of the handle member 50 includes a heel plate 112. The handle member 50 includes a heel plate supporting surface 113 upon which the heel plate 112 is positioned. In an exemplary preferred embodiment, the heel plate 112 is formed with opposing ear members 114 (only one of which is shown in FIG. 3) which are sized and shaped to be snap-fitted into the two recesses 115 formed on the inside of the handle member 50. The recesses 115 can be, but are not necessarily, bored completely through the wall of the handle member 50 as shown in FIG. 3. The ear members 114 are round and preferably include a beveled surface 115 so that it is easier to fit the ear members 114 past the supporting surface 113 and into the handle member 50 during assembly. The heel plate 112 of FIG. 3 also includes lead-in surfaces 116 which are shaped to complement and fit against the heel plate supporting surface 114 when the heel plate 112 is interference fitted or snap fitted into the base portion 54 of the handle member 50.

Preferably, the heel plate supporting surface 113 is U-shaped. This feature of the base portion 54 makes it easier to assemble the spring mechanism 64 to the rod attachment portion 62 and to insert the lever mechanism 66 into the handle member 50. Furthermore, the U-shape lessens the chances of inadvertently splitting open the base portion 54 during assembly. With regard to the lever mechanism 66, the release lever 68 and link lever 70 include indentations 117, 118, respectively, which allow them to be fitted around the rod 58. As best shown in FIG. 5, the heel plate 112 is formed with a recess 120 sized to receive a portion of the spring mechanism 64, i.e., the spring 110 with the portion of the rod 58 extending beyond the groove 111 holding the spring 110 in position.

Another key aspect of the present invention is that the heel plate 112 is shaped to provide the worker with a readily visible indication of how the scraping tool 22 is oriented in his or her hand. More specifically, and as best shown in FIG. 3, the heel plate 112 includes opposing side surfaces 122 which are asymmetrically shaped. A preferred heel plate 112 also includes a grooved surface 123 to provide friction for tapping nails into the surface being scraped. The handle member 50 also includes a gripping surface 124, e.g., gripping ribs, which is preferably positioned on an opposite side of the handle member 50 than the lever mechanism 66.

Referring to FIG. 11, an alternative heel plate 126 includes an indentation 127 sized to receive a hexagonal-shaped tool bit 128 with a screw driver tip 130. Other types of indentations can be formed in the heel plate 126 to accommodate tool bits differing in shape.

With regard to materials, the blades 24 are preferably made from 420 (heat treated) stainless steel with a Rockwell Hardness C45–52. The blades 24 can be harder, but should not exceed Rockwell 58 because then they can not be sharpened with files of Rockwell 62–68. The handle member 50 and the release lever 68 are preferably formed from 20% glass filled nylon 6/6 with a matte finish texture. The lever link 70 and the thrust washer 90 are preferably formed from acetyl. The rod 58 is preferably made from 304 stainless steel with a passivate finish. Washers 102, 106 and the retaining clip 108 preferably comprise 1095 carbon steel, heat treat Rockwell Hardness 50–54, with a zinc plate finish. The disk spring 104 preferably comprises 1095 carbon steel, heat treat Rockwell Hardness 50–54, with a zinc plate finish, and thickness between 0.020 and 0.030 inches. An exemplary preferred spring 110 is made from stainless steel, such as part numbers CC78 and 10919 from Century Spring, and is rated between 2.7 and 5.5 lbs/inch. The heel plate 112 is preferably made from die cast zinc (ZMAK#2) with a clear chromate finish to prevent corrosion.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A scraping tool system comprising:

a scraping tool including:

a handle member including an end portion and a base portion, said handle member being formed with a channel within said handle member, said base portion including a tapping heel plate;

a rod sized to be fitted within said channel, said rod including a tool attaching portion and a rod securing portion;

a spring mechanism to which said rod securing portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member;

a plurality of tools each including a mounting portion formed such that said tool is mechanically coupled to said tool attaching portion and secured to said end portion applying a spring force against said tool attaching portion when said lever mechanism is moved to a tool securing position; and a body-worn holster with pockets adapted to receive said scraping tool and said plurality of tools.

2. A scraping tool system comprising:

a scraping tool including:

a handle member including an end portion and a base portion, said handle member being formed with a channel within said handle member;

a rod sized to be fitted within said channel, said rod including a tool attaching portion and a rod securing portion;

a spring assembly to which said rod securing portion is attached, said spring assembly being fitted between said rod and said base portion of said handle member; and a lever assembly mechanically coupled to said handle member and said spring assembly and adapted to reposition said rod within said channel in response to a movement of said lever assembly relative to said handle member;

a plurality of tools each including a mounting portion formed such that said tool is mechanically coupled to said tool attaching portion and secured to said end portion when said lever assembly is moved to a tool securing position; and a holster with pockets adapted to receive said scraping tool and said plurality of tools.

3. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member;

said rod and said channel being shaped such that said channel contacts said rod to prevent said rod from rotating about an axis parallel to said rod as said rod is repositioned within said channel.

4. The scraping tool system of claim 3 wherein:

said lever mechanism is formed with a high-density plastic.

5. The scraping tool system of claim 3 wherein:

said handle member includes a gripping surface.

6. The scraping tool system of claim 3 wherein:

said gripping surface includes gripping ribs.

7. The scraping tool system of claim 3 wherein:

said gripping surface is positioned on said handle member on an opposite side of said handle member than said lever mechanism.

8. The scraping tool system of claim 3 wherein:

said base portion includes a grooved surface.

9. The scraping tool system of claim 3 further comprising:

at least one tool including a mounting portion formed such that said tool is mechanically coupled to said tool attaching portion and secured to said end portion when said lever mechanism is moved to a tool securing position.

10. The scraping tool system of claim 9 wherein:

said at least one tool comprises a blade.

11. The scraping tool system of claim 9 wherein:

said at least one tool comprises a scraper.

12. The scraping tool system of claim 9 wherein:

said at least one tool comprises a grill scraper.

13. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member;

a lever mechanism mechanically coupled to said handle member and said spring mechanism and adapted to reposition said rod within said channel in response to a movement of said lever mechanism relative to said handle member; and a thrust washer positioned between said lever mechanism and said spring mechanism.

14. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member;

said lever mechanism including:

a release lever including a camming portion with a cammed surface, said release lever being mechanically coupled to said handle member; and a link lever including a linking portion and a thrusting portion, said linking portion including a surface complementary to said cammed surface, said thrusting portion being mechanically coupled to said spring mechanism.

15. The scraping tool system of claim 14 further comprising:

a thrust washer positioned between said lever mechanism and said spring mechanism, said thrust washer including a curved surface shaped to receive said thrusting portion.

16. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member;

said rod and said channel being shaped such that said channel contacts said rod to cause said rod to rotate about an axis parallel to said rod as said rod is repositioned within said channel.

17. A scraping tool system comprising:

a handle member including an end portion and a base portion, said handle member being formed with a channel within said handle member, said base portion including an indentation sized to receive a tool bit;

a rod sized to be fitted within said channel, said rod including a tool attaching portion and a rod attachment portion;

a spring mechanism to which said rod attachment portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member.

18. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member; and a lever mechanism mechanically coupled to said handle member and said spring mechanism and adapted to reposition said rod within said channel in response to a movement of said lever mechanism relative to said handle member;

said handle member including a heel plate supporting surface;

said base portion comprising a heel plate positioned on said heel plate supporting surface.

19. The scraping tool system of claim 18 wherein:

said heel plate includes opposing side surfaces which are asymmetrically shaped.

20. The scraping tool system of claim 18 wherein:

said heel plate is formed with a recess sized to receive a portion of said spring mechanism.

21. The scraping tool system of claim 18 wherein:

said heel plate supporting surface is U-shaped.

22. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member;

a lever mechanism mechanically coupled to said handle member and said spring mechanism and adapted to reposition said rod within said channel in response to a movement of said lever mechanism relative to said handle member; and at least one tool including a mounting portion formed such that said tool is mechanically coupled to said tool attaching portion and secured to said end portion when said lever mechanism is moved to a tool securing position, said at least one tool comprising a brush.

23. The scraping tool system of claim 22 wherein:

said brush is a grill brush.

24. A scraping tool system comprising:

a handle member including an end portion and a base portion, said handle member being formed with a channel within said handle member;

a rod sized to be fitted within said channel, said rod including a tool attaching portion and a rod attachment portion;

a spring mechanism to which said rod attachment portion is attached, said spring mechanism being fitted between said rod and said base portion of said handle member;

a lever mechanism mechanically coupled to said handle member and said spring mechanism and adapted to reposition said rod within said channel in response to a movement of said lever mechanism relative to said handle member;

a plurality of blades each including a mounting portion formed such that said blade is mechanically coupled to said tool attaching portion and secured to said end portion when said lever mechanism is moved to a tool securing position; and a holster with pockets adapted to receive said handle member and said plurality of blades.

* * * * *